US007892319B2

(12) United States Patent
Massaro et al.

(10) Patent No.: US 7,892,319 B2
(45) Date of Patent: Feb. 22, 2011

(54) CRUST BREAKER AND ORE DISPENSER

(75) Inventors: Peter C. Massaro, Syracuse, NY (US); Michael F. Carno, Baldwinsville, NY (US)

(73) Assignee: Trol-Mation, Inc., Syracuse, NY (US)

( * ) Notice: Subject to any disclaimer, the term of this patent is extended or adjusted under 35 U.S.C. 154(b) by 483 days.

(21) Appl. No.: 12/138,462

(22) Filed: Jun. 13, 2008

(65) Prior Publication Data

US 2009/0308625 A1 Dec. 17, 2009

(51) Int. Cl.
*C22B 21/00* (2006.01)
*C21C 7/00* (2006.01)

(52) U.S. Cl. ..... 75/684; 266/216; 266/44

(58) Field of Classification Search ..... 266/44, 266/216, 271; 75/684; 204/67; 205/230
See application file for complete search history.

(56) References Cited

U.S. PATENT DOCUMENTS

| | | | | |
|---|---|---|---|---|
| 3,673,075 | A | | 6/1972 | Kibby |
| 3,681,229 | A | | 8/1972 | Lowe |
| 3,714,002 | A | | 1/1973 | Kibby |
| 4,328,085 | A | | 5/1982 | Friedli et al. |
| 4,437,964 | A | | 3/1984 | Gerphagnon et al. |
| 5,108,557 | A | * | 4/1992 | Nordquist ..... 205/392 |
| 5,158,655 | A | * | 10/1992 | Townsend ..... 205/380 |
| 5,227,045 | A | * | 7/1993 | Townsend ..... 205/230 |
| 5,324,408 | A | | 6/1994 | Kissane |
| 5,423,968 | A | | 6/1995 | Kissane |
| 5,476,574 | A | | 12/1995 | Welch et al. |
| 6,408,740 | B1 | | 6/2002 | Holt et al. |
| 6,436,270 | B1 | | 8/2002 | Sander |

FOREIGN PATENT DOCUMENTS

| | | |
|---|---|---|
| DE | 197 09 648 A1 | 9/1998 |
| WO | WO 94/01601 A1 | 1/1994 |

* cited by examiner

*Primary Examiner*—Scott Kastler
(74) *Attorney, Agent, or Firm*—Bernard P. Molldrem, Jr.

(57) ABSTRACT

A crust breaker and ore feeder device for electrolytic aluminum smelting employs an in-line three-position pneumatic cylinder capable of moving the plunger shaft to a fully raised position, to a fully lowered position, and to an intermediate, partly lowered position. The full stroke is used for a conventional combined ore dispensing and a crust breaking operation; a partial stroke between the fully raised position and the intermediate position permits ore dispensing without a crust breaking; and a partial stroke between the intermediate position and the fully lowered position permits crust breaking operation without ore feeding. The cylinder can take form of a tandem cylinder having upper and lower axially aligned cylinder portions, with rods not connected to one another.

8 Claims, 6 Drawing Sheets

CRUST BREAKER AND ORE DISPENSER

BACKGROUND OF THE INVENTION

This invention relates to electrolytic smelting of aluminum from aluminum ore, and is more particularly concerned with a device for breaking the solidified crust that forms on the molten electrolyte and for metering doses of aluminum ore into the electrolytic bath to replenish the material that has been separated as aluminum metal. The invention is more specifically directed to a combined crust breaker and ore dispenser tool that is installed on the aluminum smelting tank or pot, and which can be remotely actuated to break the electrolyte crust or to add aluminum ore material, as needed.

The smelting process produces aluminum from an alumina powder, dissolved in a molten electrolyte, such as cryolyte, and where electric current is applied to the molten electrolyte bath. This takes place in a large vessel, or pot, which is closed off at the top to control off gasses produced by electrolysis. The metallic aluminum yield is siphoned off, in liquid form. Alumina powder is added to replace the portion that has been reduced to metal, and the process is run on a continuous basis. The molten electrolyte tends to solidify at the top surface and form a solid crust. The crust blocks off the molten electrolyte from the alumina powder that is added, and so the smelting equipment must include means for breaking up this crust to feed new alumina into the pot, so that the process can continue. The formation of crust complicates the automated smelting process because there are high electric currents involved, and the electrical properties of the bath depend on the concentration of alumina. If alumina powder is simply dispensed by depositing it onto the crust, followed by breaking of the crust, the alumina tends to drop into the bath in uncontrolled quantities, which can cause large swings in alumina concentration, upsetting the electrical characteristics of the bath. Also, when the crust is broken and the chunks of solidified material remelt, this can also dilute the electrolyte concentration and cause unpredictable electrical behavior.

It is typical for a smelting pot to employ a number of pneumatically driven crust breaker devices, each of which has a vertical shaft that can be driven vertically. The shaft typically has a hammer or chisel formed at the lower end. When the shaft is driven downward, the chisel penetrates the crust and forms an opening in it that permits the alumina to pass down into the molten electrolyte below. There is also a dispenser cup on the device that fills from an ore hopper when the shaft is in the raised position, and which dispenses the ore from the cup when the shaft descends. Thus, with this type of crust breaker device, each cycle drives the chisel through the crust of the electrolyte, and also dispenses a predetermined quantity of alumina ore.

The tying of the ore dispensing operation with the crust breaking operation does limit the effectiveness of this tool. When only crust breaking is required because too much crust has formed, then each actuation of the tool will dispense a measured quantity of the alumina, whether it is needed or not, each time the chisel is driven through the crust. Likewise, if only ore dispensing is needed, each time that the ore is dispensed the chisel is driven down into the electrolyte. It has been found that the presence of the chisel in the molten electrolyte can change the electrical characteristics of the bath, and so consequently it has been desired for some time to find a way to separate the ore dispensing operation from the crust breaking operation. Also, the heating of the chisel from repeated plunging into the bath causes the bath to adhere to the chisel, reducing the efficiency of the operation.

Most smelting bath assemblies at present have positions on the top cover where these crust breakers are installed, and it is also desired that any replacement tool with separate ore dispensing and crust breaking operations should be sized to occupy those spaces so that retrofitting can be performed as inexpensively and as easily as possible.

One previously proposed device for feeding alumina into the elecrolyte bath and for breaking the crust when needed, is discussed in Gerphagnon et al. U.S. Pat. No. 4,437,964. This device has two separate tools situated side by side, one being a crust breaker plunger and the other being the alumina dispenser. Because there are two separate tools used to perform these functions, the tool does not easily fit into the same geometry as the standard crust breaker tool that it would replace. Also, the crust breaker and the dispenser require separate air cylinders, which complicates the construction and the control mechanism.

Another proposed crust breaker and ore dispensing device is discussed in Kissane U.S. Pat. No. 5,423,968. In this proposed device, a first air cylinder at the top of the shaft of the crust breaker is used to drive the hammer or chisel end into the crust when needed. A second air cylinder is formed around a lower part of the shaft to control the dispensing cup independently of the crust breaker plunger. That is, a slide cylinder is formed around the plunger shaft, to control the upper seal and lower seal of the dispensing cup. This unit does fit into the same geometry as a standard, combined crust breaker and dispenser, and is capable of performing independent dispensing and crust breaking operations. However, this device does have several drawbacks. The device of the Kissane patent requires replacing the entire dispensing unit, and does not use any of the parts that it replaces, so it is requires a significant added expense to install these units. Also, the Kissane device requires sliding parts at the lower end where there are an abundance of highly abrasive alumina dust and also highly corrosive process off gases. The main alumina valve allows flow of the alumina dust up through the slide mechanism, resulting in the actuator for the dispensing cup experiencing a high rate of wear. The high friction surface is also exposed to the highly corrosive environment, and so the mechanical parts of the dispensing device are exposed to contamination each time the ore material is discharged.

Thus, there remains a need for a simpler arrangement that allows the ore dispensing and crust breaking functions to be separated, but which employs as much of the standard crust breaker and dispenser as possible, and which avoids placing high friction critical surfaces in the places where there are significant levels of corrosives and/or abrasives.

OBJECTS AND SUMMARY OF THE INVENTION

Accordingly, it is an object of the invention to provide a crust breaking and ore dispensing device that permits the dispensing and crust-breaking functions to be separated, and which avoids the drawbacks of the prior art.

It is another object to provide a crust breaking and ore dispensing device that fits into the same opening provided for the current devices, to facilitate retrofitting of the aluminum smelting pot.

It is also an object to provide a device that can be implemented by substituting only the air cylinder or actuator of the current device, and thus retaining as much of the current equipment design as possible.

It is a further object to facilitate control of the air device by optionally permitting the control valves for the device to be mounted as close to the air cylinder as possible.

According to an aspect of this invention, a crust breaker and ore feeder device is provided for an electrolytic aluminum smelting pot of the type that contains a molten electrolyte in which aluminum ore is dissolved for electrolytic reduction into aluminum metal. The crust breaker and ore feeder device is preferably of the type in which a vertical shaft is positioned above the molten electrolyte and is movable along its vertical axis. A crust breaker chisel is mounted at the lower end of the shaft, and when the shaft is driven downward this chisel breaks the crust that forms on the upper surface of the molten electrolyte. There is also an ore dispenser situated over the shaft. This has an open bottom and open top. An upper closure is normally open when the shaft is fully raised to admit ore into the dispenser from an ore hopper. The upper closure closes off the upper opening of the dispenser when the shaft is lowered, so additional ore is blocked from the dispenser cup during the dispensing operation. A dispensing valve normally closes off the lower opening of the dispensing cup, and this valve opens to release the ore from the dispenser when the shaft is lowered. A pneumatic cylinder is controllably actuated and serves for raising and lowering the shaft to dispense ore and to break the crust. In the improved device of this invention, the pneumatic cylinder is in the form of an in-line three-position pneumatic cylinder capable of moving the shaft to a fully raised position, to a fully lowered position, and to an intermediate, partly lowered position. A control arrangement applies compressed gas to the various ports of the three-position cylinder, such that the cylinder provides different strokes for different operations: A full stroke moves the shaft from the fully raised position to the fully lowered position to perform an ore dispensing operation and a crust breaking operation; a partial stroke, i.e., between the fully raised position and the intermediate position, is employed to perform an ore dispensing operation without a crust breaking operation; and a partial stroke between the intermediate position and the fully lowered position is employed to perform a crust breaking operation without an ore feeding operation.

In a preferred embodiment, the in-line three-position cylinder is in the form of a tandem cylinder having upper and lower cylinder portions that are axially aligned, and having respective upper and lower pistons. The upper piston has a relatively short rod, and moves for a short stroke sufficient to carry out an ore dispensing operation without a crust breaking operation. The second piston has a longer rod, and moves for a longer stroke sufficient to carry out a crust breaking operation. The tandem cylinder has upper cap at a top end of the cylinder, a lower cap at a lower end of the cylinder, and an intermediate stop plate positioned between the upper and lower caps. The first piston is situated between the upper cap and the intermediate stop plate and has its rod passing through a bore in the stop plate. The second piston is disposed between the stop plate and the lower cap, and has a rod passing through a bore in the lower cap, and the rod is connected to the upper end of the vertical plunger shaft. The lower end of the first piston rod is not connected to the second piston or the second rod, but rests against the second piston when the second piston is in the raised position, so that the first piston rod is operative to push against the second piston and move the second piston and rod downward, as far as the partial or intermediate position.

There are first air port and an optional second air port disposed in the upper cap and the stop plate, respectively, for actuating the first or upper piston, and third and fourth air ports disposed in the stop plate and said lower cap, respectively, for actuating the second or lower piston.

The pneumatic control mechanism for the three-position in-line cylinder can be situated adjacent the cylinder, to minimize the amount of hosing needed and to facilitate installation and maintenance.

The above and many other objects, features, and advantages of this invention will become apparent to persons skilled in the art from the ensuing description of a preferred embodiment, which should be considered in connection with the accompanying Drawing.

DETAILED DESCRIPTION OF A PREFERRED EMBODIMENT

Figure 1:
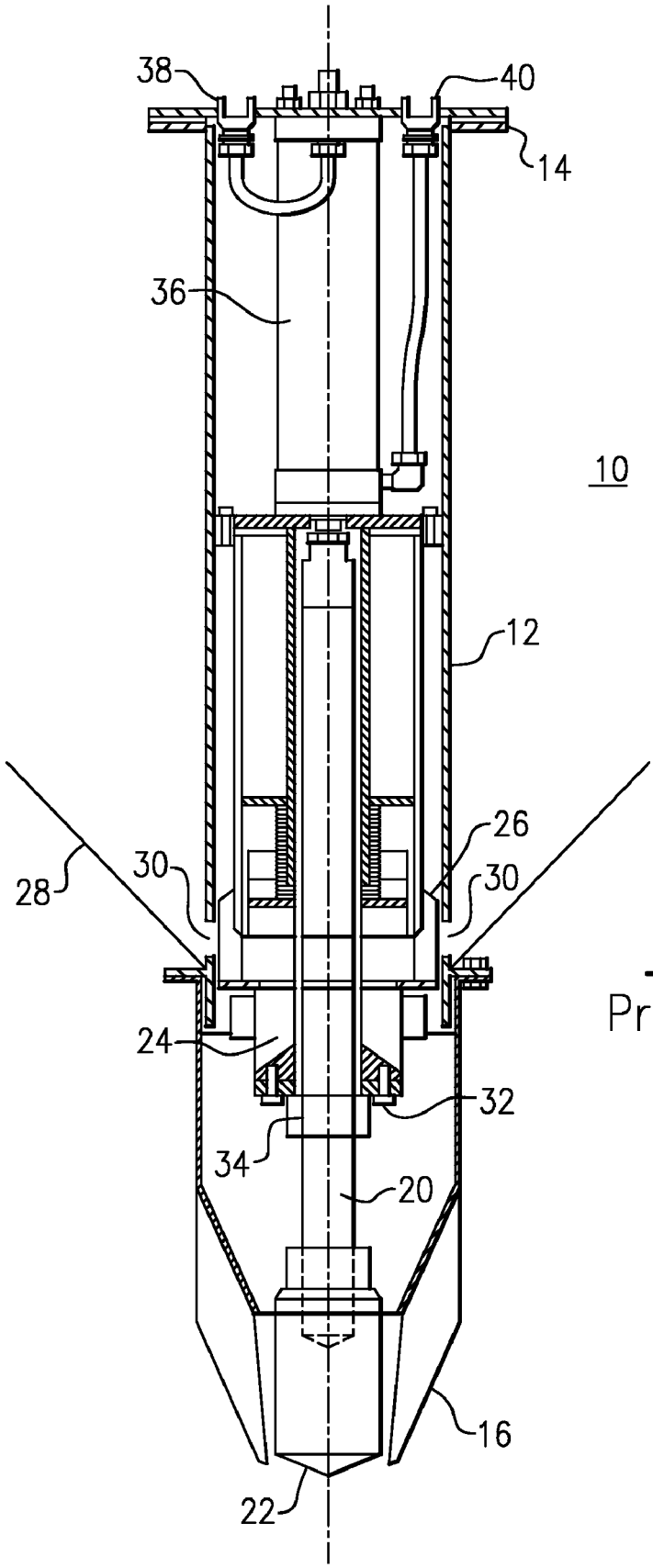
FIG.1 Prior Art
FIG. 1 is a longitudinal section of a crust breaker and ore feeder device according to the prior art.

With reference to the Drawing, a typical ore feeder and crust breaker arrangement 10 according to the current state of the art is shown in FIG. 1. The feeder and crust breaker assembly 10 is positioned on the top wall or cover of an aluminum smelting pot, not shown, above the molten electrolyte. The assembly 10 has an elongated cylindrical housing 12, with a mounting flange 14 at its top. The housing 12 fits within a round opening provided in the top cover of the pot. There is a tapered lower end 16 that is intended to confine the distribution of the alumina so that it is dispensed near the opening that is created in the top crust layer.

A plunger shaft 20 extends along the vertical axis of the assembly 10 and is adapted for vertical motion along that axis. There is a chisel 22 mounted at the lower end of the shaft 20, and this chisel is adapted to break through the crust on the electrolyte upper surface to create an opening to admit the alumina powder into the molten liquid. Typically, the chisel has a non-metallic surface so as not to react chemically with the electrolyte. However, a surface coating of contaminates can develop on the chisel 22, and its presence within the electrolyte can sometime produce adverse electrical effects within the molten electrolyte.

A dose holder or cup 24 is located above the plunger chisel 22 within the housing. The dose holder 24 is typically of a cylindrical shape with an open upper end to receive the alumina powder and an open lower end for dispensing the powder. There is a cylindrical gate 26 that moves upward and downward, relative to the cup 24, to admit the ore powder into the cup and to close off the cup, respectively. A supply of alumina powder is contained within a hopper 28, and this alumina proceeds through apertures or ports 30 in the housing 12 to the dose holder 24. A valve seat 32 is positioned on the shaft 20 at the lower end of the cup or dose holder 24. This valve seat 32 moves down when the shaft descends to open the dispenser cup and allow the alumina powder to fall from the cup and out the lower end of the housing. When the shaft ascends to its raised position, the valve seat 32 closes off the cup 24, and the gate 26 opens to admit the next measured dose of alumina powder. The valve seat 32 is slidable on the shaft 20, and a sleeve 34 on the shaft supports the valve seat 32 from below, so that the seat 32 moves downward a small distance when the shaft descends, and returns back to the closed position when the shaft 20 is fully raised.

An air cylinder 36 is disposed within the upper part of the housing 12. This cylinder 36 has a piston and rod, not shown, with the rod being connected to an upper end of the shaft 20. Here, the cylinder is a two-position cylinder, with upper and lower air ports and with a first air supply line 38 for driving the shaft 20 and chisel 22 downwards, i.e. to a fully extended position, when air is supplied, and a second air supply line 40 for raising the shaft and chisel back to their elevated position when air is supplied. There is a pneumatic control (not shown) for controlling the application of compressed air to the first and second supply lines. Typically, the pneumatic control is located at some distance from the feeder and crust breaker assembly, which necessitates having numerous air lines extending above the pot cover to reach each of the feeder and crust breaker assemblies for that pot.

Because of changing smelting conditions within the aluminum smelting pot, it is sometimes desirable to dispense ore one or more times without plunging the chisel into the molten electrolyte, and it is sometimes desirable to conduct multiple crust breaking operations without dispensing additional powdered ore. However, conducting a crust breaking operation without ore dispensing is not possible with the prior art device, nor is it possible to conduct a dispensing operation without also conducting a crust breaking operation.

Figure 2:
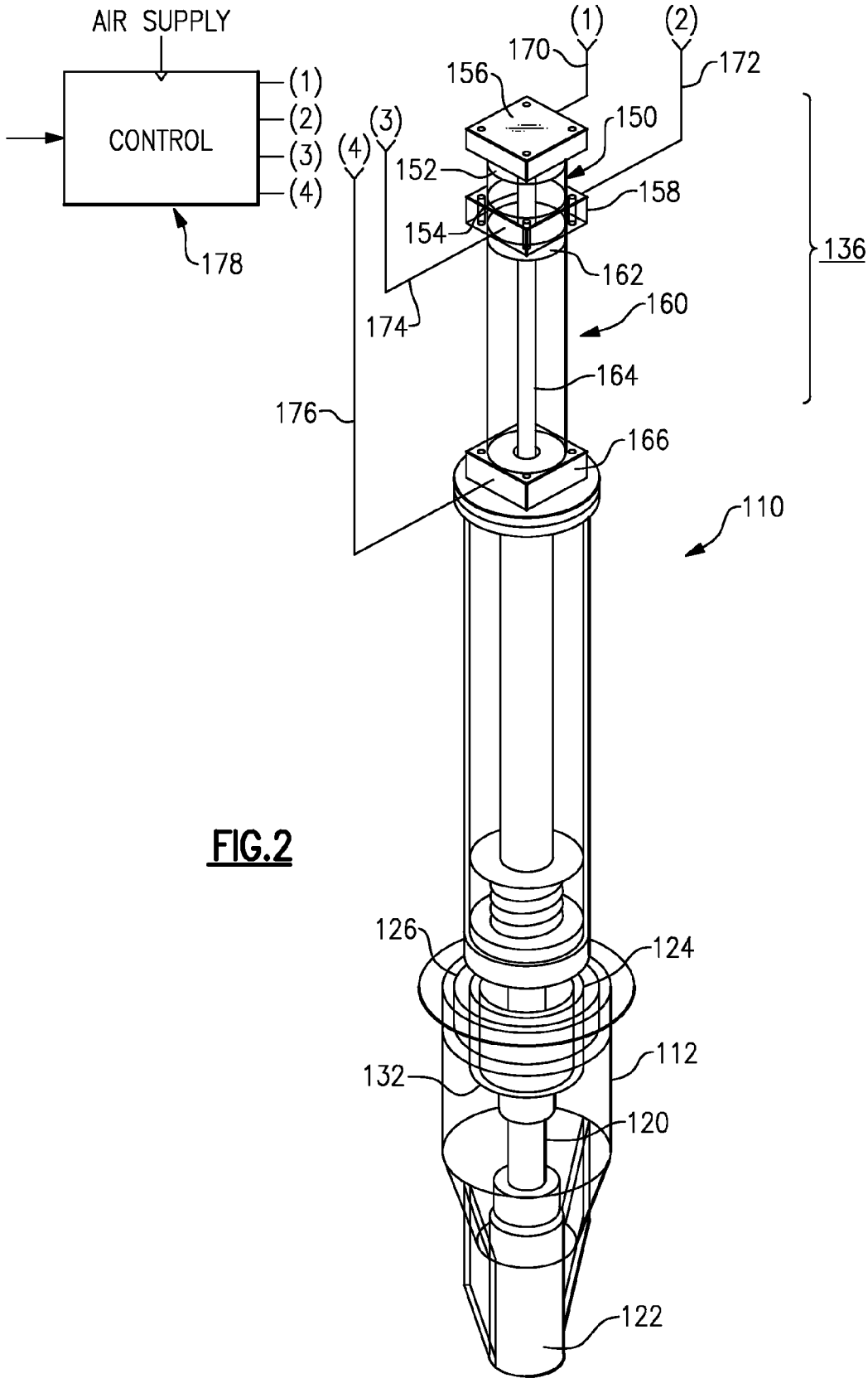
FIG. 2 shows a crust breaker and ore feeder device incorporating a tandem, 3-position dual air cylinder, according to an embodiment of the present invention.

An ore dispensing and crust breaker assembly 110 according to an embodiment of the present invention is shown in FIG. 2, and in more detail in FIGS. 3, 4, 4A, 4B, 5 and 5A. Here, the elements that are similar or identical to corresponding elements in the assembly 10 of FIG. 1 are identified with the same reference numbers, but raised by 100. For those elements, a detailed description is not necessary.

As shown in FIG. 2, the cylindrical housing 112 is the same geometry as in the prior art device, so that the assembly 110 of this invention can be retrofitted into existing structure in smelting pots that are now in use. Here, a portion of the housing 112 is omitted in the illustration. The shaft 120, chisel 122 and cup or ore dispenser 124 are the same construction as previously described, as are the cylindrical gate 126 and lower valve seat 132. However, at the upper end of the arrangement, this embodiment employs a three-position tandem or piggy-back double air cylinder 136, as now described. This double cylinder can achieve a fully ascended position and a fully extended or lowered position, as with the prior art arrangement, but is also capable of a partial-stroke intermediate position which can be used for ore dispensing without crust breaking, or for crust breaking without ore dispensing.

The three-position in-line double air cylinder 136 has an upper, short-stroke cylinder 150, with a piston 152 and rod 154, an upper end block or cap 156, and an intermediate stop plate 158 where the upper cylinder 150 joins a second, full-stroke cylinder 160. The upper cylinder rod 154 passes through a center bore in the intermediate stop plate 158. The lower cylinder has a piston 162 and lower rod 164. The end of the upper cylinder rod 154 rests against the top of the piston 162, i.e., against the upper end of the rod 164, but is not attached to or connected to the piston 162 or rod 164. The lower rod 164 passes through a bore in the a lower end block or cap 166 and is connected to the upper end of the plunger shaft 120. The double air cylinder thus is capable of a first, fully raised position, where both pistons 152 and 162 are raised, an second, intermediate position where the upper cylinder is actuated so that the piston 152 is descended, pushing the piston 162 and rod 164 down a partial stroke, and a third, fully lowered position in which the cylinder 160 is actuated so that the piston 162 and rod 164 are fully descended.

As illustrated schematically, there are first, (optional) second, third, and fourth air lines 170, 172, 174 and 176, supplying compressed air to the upper end of cylinder 150, the lower end of cylinder 150, the upper end of cylinder 160 and the lower end of cylinder 160, respectively. A pneumatic control arrangement, here also shown only schematically, selects the air lines to which to apply compressed air, depending upon conditions detected within the smelting pot. The air line 170 leads to a first port in the upper cap 156; the second air line 172 leads to a second port, for the upper cylinder 150, the second port being in the stop plate 158. The third air line 174 leads to a third port, located in the stop plate 158, which serves the lower cylinder 160, and the fourth air line 176 leads to a fourth air port that is located in the lower cap 166. As a practical matter, air does not need to be applied to the second air line 172, as the rod 154 and piston 152 will be driven up by the piston 162 when the air pressure is relieved from the first air line 170 and the third air line 176. The fourth air line 176 can have constant air pressure applied during dispensing, as the differential area of the piston 162, between its upper and lower surfaces, will cause that piston to descend for the short dispensing stroke when air pressure is applied to the third air line 174, and then rise when that air pressure is relieved. Air pressure is relieved from line 176 and applied to line 174 for crust breaking. This means air pressure needs to be controlled only for the three air lines 170, 174 and 176, thereby simplifying the pneumatic controls, and simplifying the cylinders also.

Figure 3:
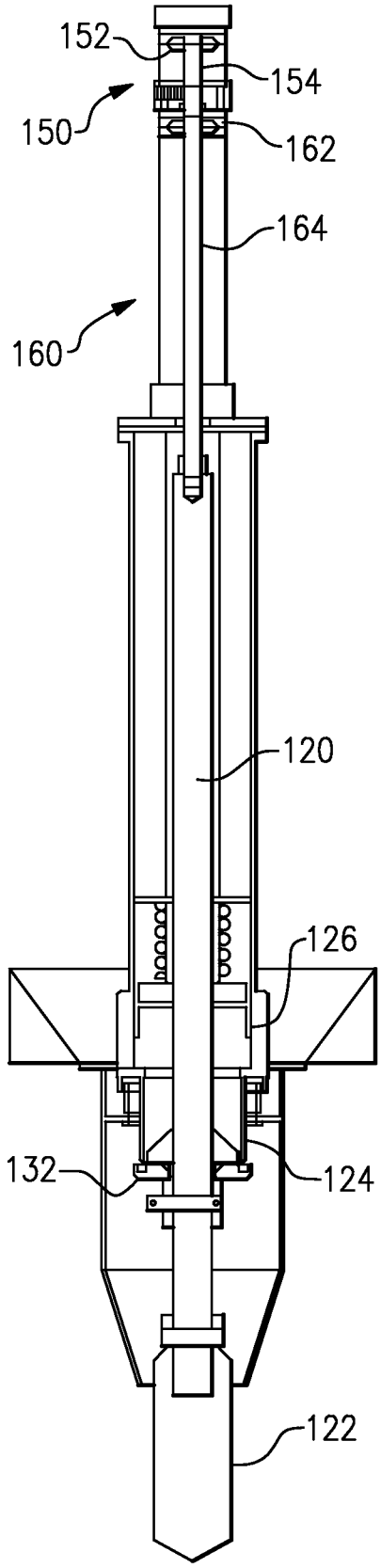
FIG. 3 is a longitudinal section thereof, with the crust breaker shaft fully raised.

FIG. 3 illustrates the condition in which both the upper cylinder 150 and lower cylinder 160 are fully raised, i.e., so that the plunger shaft 120 and chisel 122 are withdrawn as high as possible above the electrolyte within the smelting pot. Here, the gate 126 is raised, so that the dispensing cup 124 is open to receive a fill of the alumina powder from the hopper 130. The seat 132 is raised, i.e., closed. Also, the plunger chisel 122 is fully raised.

Figure 4:
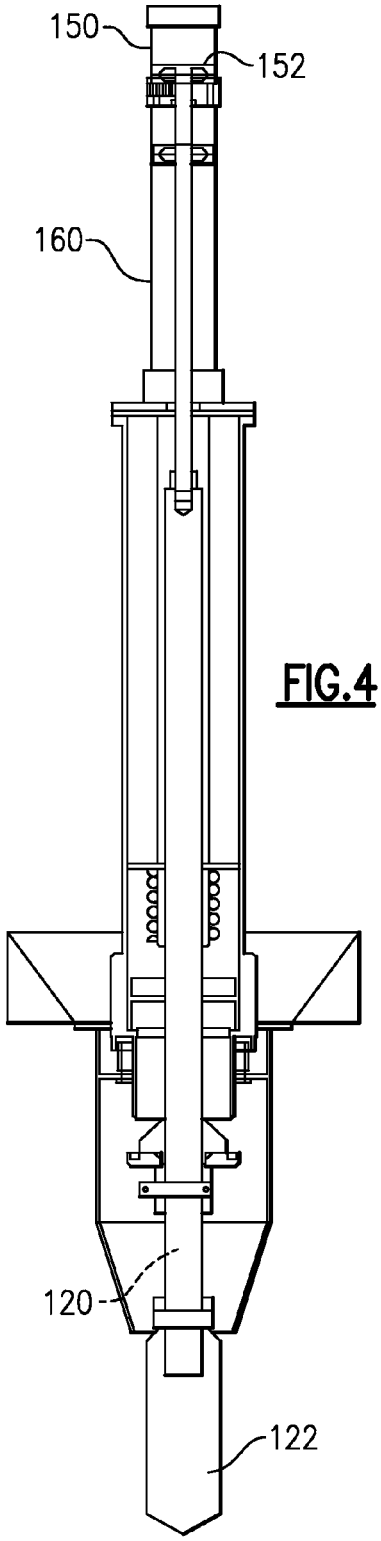
FIG. 4 is a longitudinal view thereof showing the crust breaker shaft partially extended.
Figure 4A:
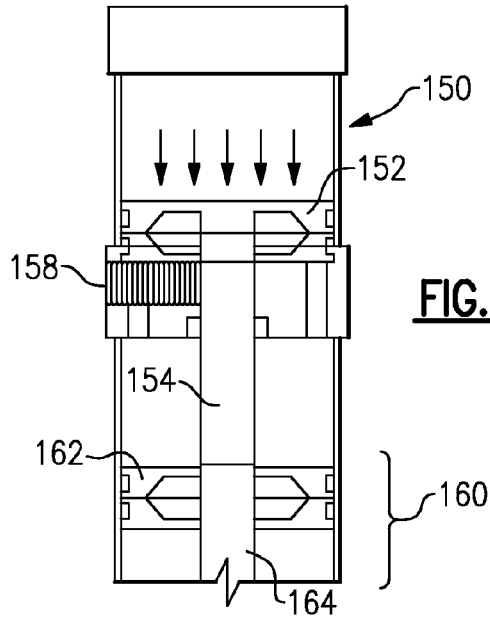
FIG. 4A is a detail view of the upper cylinder portion thereof.
Figure 4B:
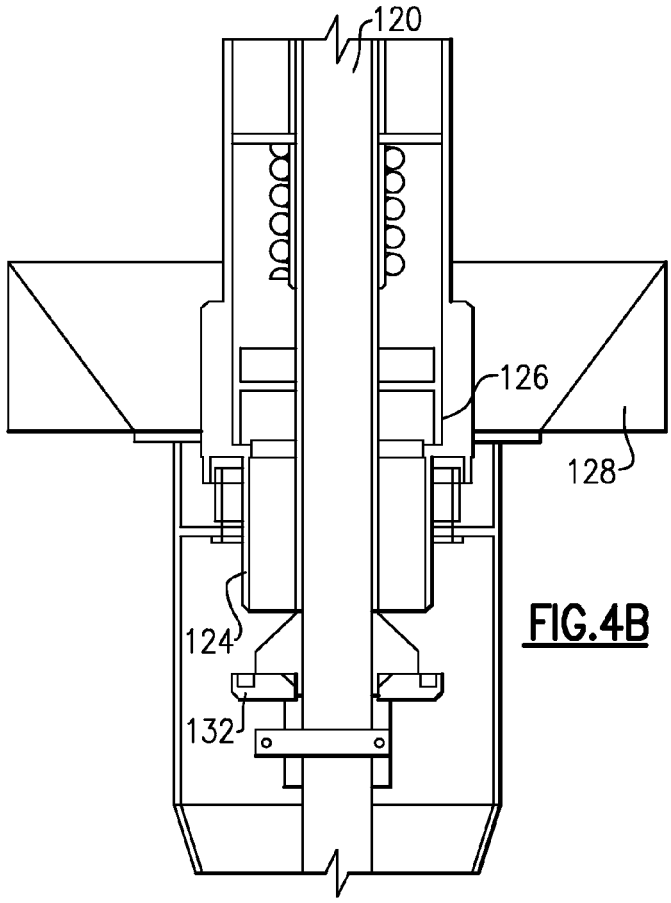
FIG. 4B is a detail view of the ore dispenser cup portion thereof.

FIG. 4 illustrates the condition in which the upper cylinder 150 is actuated, so that the lower rod 164 and the shaft 120 are moved to the intermediate position. Here, the gate 126 is closed, and the valve seat 132 is opened, so that the predetermined dose of alumina powder is dropped out the housing onto the electrolyte below. Until air is supplied to the second air line 172 to raise the upper piston 152, the gate 126 remains down, and the dispensing cup 124 will not refill from the hopper 130. Details of the upper and lower cylinders 150, 160 is shown in FIG. 4A. The relation of the dispensing cup, gate, and seat is shown in FIG. 4B. The chisel 122 is descended only a small distance, and remains above the upper surface of the molten electrolyte and above any crust that may have formed on it. The arrangement 110 of this embodiment can be actuated between the first (FIG. 3) position and the second or intermediate (FIG. 4) position for conducting an ore dispensing operation without crust breaking.

Figure 5:
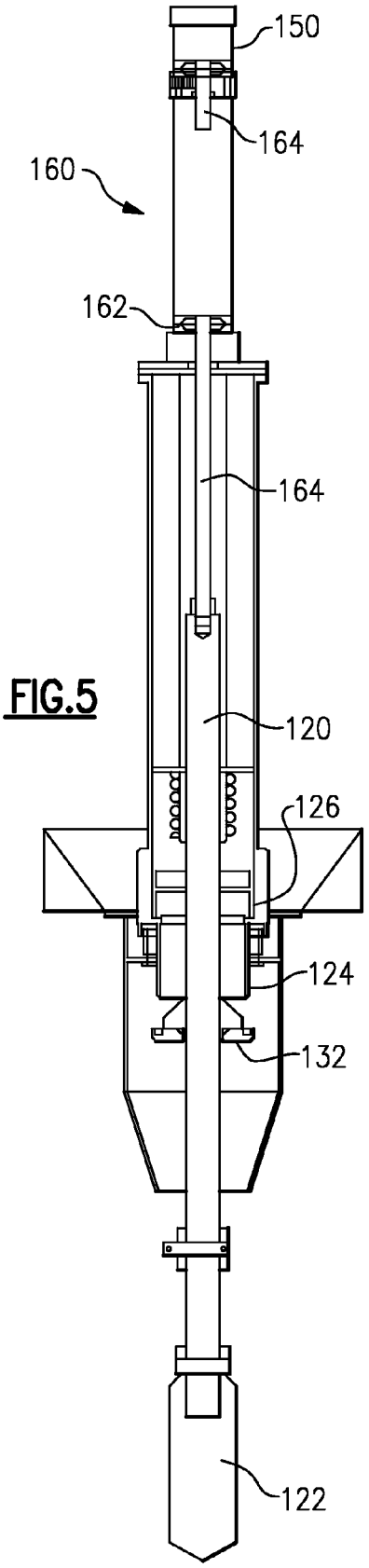
FIG. 5 is a longitudinal section of the crust breaker and ore feeder of this embodiment, showing the crust breaker shaft fully extended.
Figure 5A:
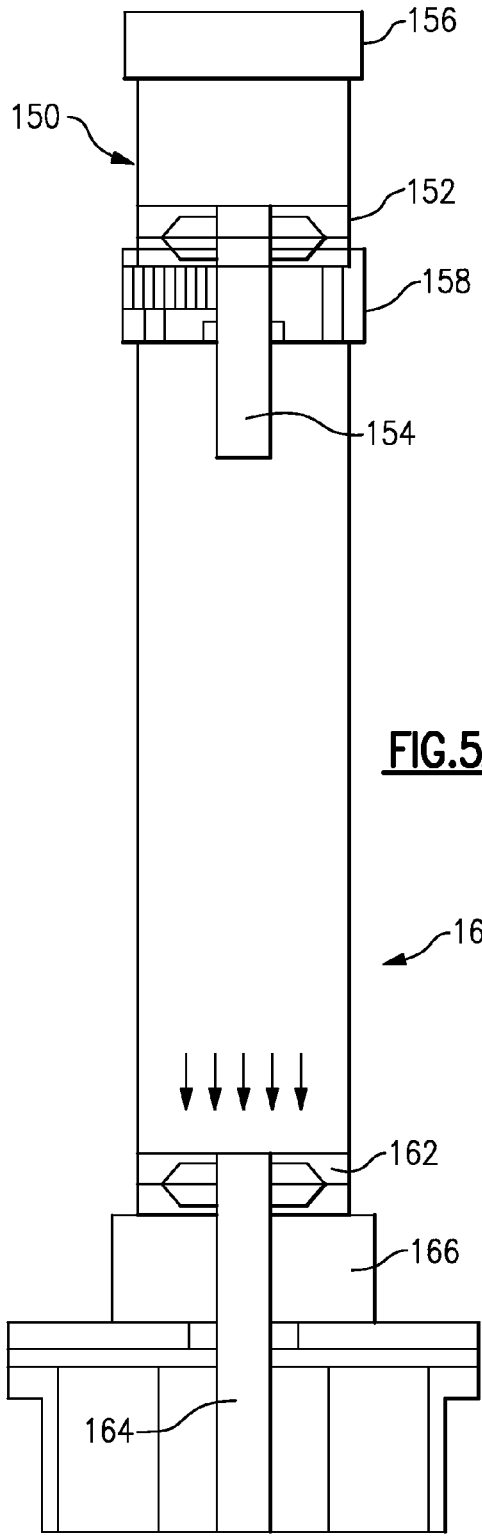
FIG. 5A is a detail view thereof showing the upper and lower cylinder portions.

FIGS. 5 and 5A illustrate the condition in which both the upper cylinder 150 and the lower cylinder 160 are actuated. The lower piston 162 and lower rod 164 are fully descended, and the shaft 120 and chisel 122 are driven to a fully extended position. If the cylinder 150 remains actuated, i.e., with air supplied to the first air line 170, then the lower cylinder piston 162 and rod 164 move between the position shown in FIG. 4 and the fully extended position shown here. So long as the upper cylinder piston 152 is in the position shown in FIG. 5A, the lower piston 162 and rod 164 cannot rise above the intermediate position shown in FIG. 3A. In the intermediate position, the ore fill gate 126 remains down, the dispensing cup does not refill with ore. Thus by moving the ore dispensing and crust breaking arrangement of this embodiment between the intermediate and fully extended positions of FIG. 4 and FIG. 5, one or more repeated crust breaking operations can be carried out without dispensing additional ore.

Of course, in normal conditions, only the lower cylinder 160 needs to be actuated, so that the dispensing and crust breaking arrangement 110 is moved between the first position (FIG. 3) and third, full-extension position (FIG. 5) for combined ore dispensing and crust breaking.

The arrangement of this embodiment, or of other equivalent embodiments, achieves a great deal of operational flexibility with a relatively simple modification from the standard arrangement, and without compromising the air cylinder. By positioning a double in-line cylinder at the upper part of the housing above the plunger shaft 120, the cylinder 136 is clear of the abrasive alumina powder that is constantly moving past the lower end of the shaft, so the risk of cylinder failure is kept low. Also, the double in-line cylinder has the same diameter of the single cylinder 36 of the prior art, so the same installation footprint is observed. This enables retrofitting of the equipment of this invention into the same openings in the smelting pot cover that are already provided for the current design of dispensing and crust breaking devices.

The pneumatic control 178 can be mounted adjacent the cylinder 150, e.g., either directly atop the upper cylinder 150 or alongside the cylinder 150, thus simplifying the air distribution design for the smelting pot.

Figure 6:
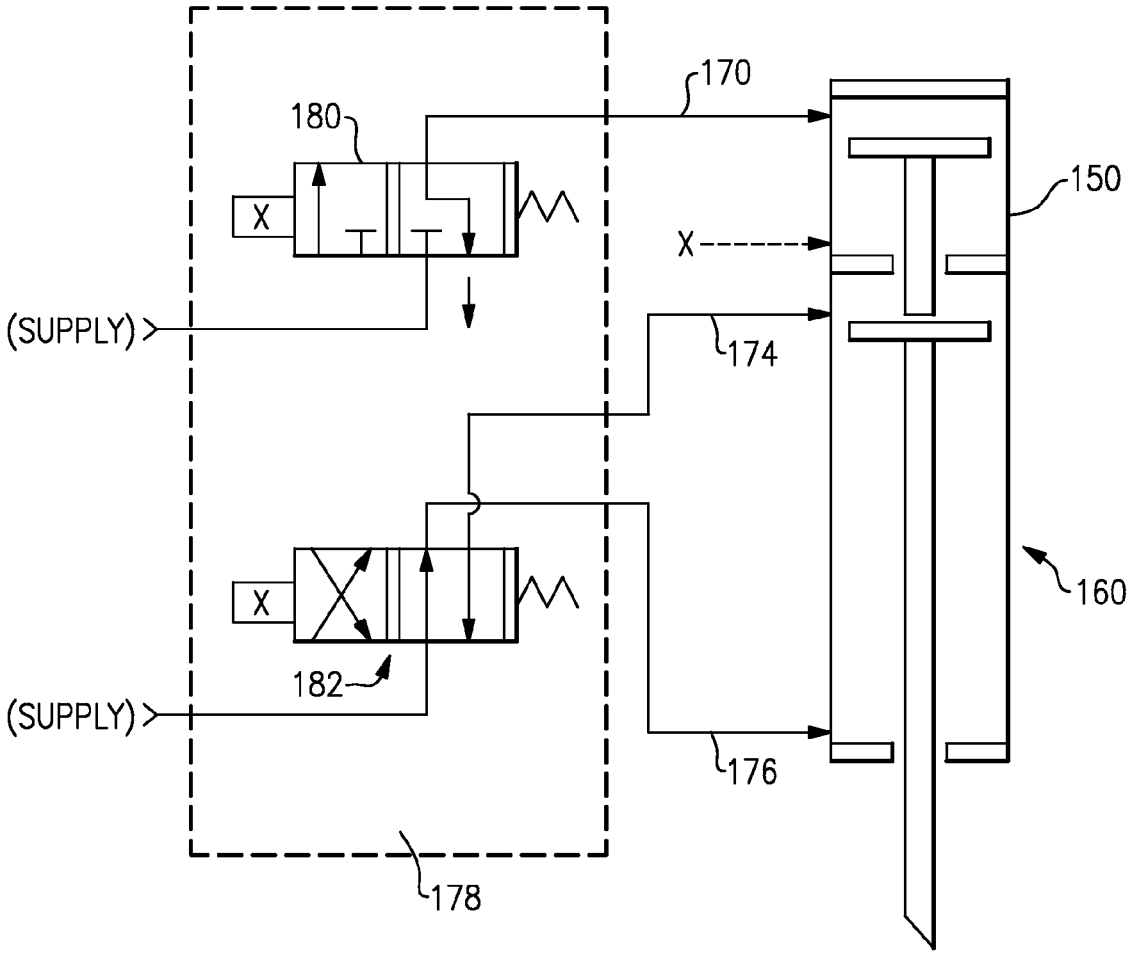
FIG. 6 is a schematic of one possible pneumatic control arrangement for this embodiment.

One possible implementation of the pneumatic control arrangement 178 is shown in FIG. 6, with a solenoid valve controlling application of supply compressed air to the air line 170 (feeding the upper cylinder 150), and a second solenoid valve 182 controlling the application of supply compressed air to the air lines 174 and 176 (feeding the lower cylinder). Other implementation are possible.

While the invention has been described in reference to a preferred embodiment, it should be understood that the invention is not limited to that precise embodiment. Rather, many modifications and variations will present themselves to those skilled in the art without departing from the scope and spirit of the invention, as defined in the appended claims.

We claim:

1. A crust breaker and ore feeder device for an aluminum smelting pot that contains a molten electrolyte in which aluminum ore is dissolved for electrolytic reduction into aluminum metal, the device being of the type in which a vertical shaft is positioned above the molten electrolyte for axial vertical motion, and which has a crust breaker chisel mounted at a lower end thereof for breaking a crust that forms on an upper surface of the molten electrolyte, and has an ore dispenser situated over said shaft, in which an upper closure is open when the shaft is fully raised to admit ore into the dispenser from an ore hopper and closes when the shaft is lowered; and a dispensing valve that releases the ore from the dispenser when said shaft is lowered; and a pneumatic cylinder for controllably raising and lowering said shaft to dispense said ore and to break said crust; and comprising the improvement wherein said pneumatic cylinder comprises a) an in-line three-position pneumatic cylinder capable of moving the shaft to a fully raised position, to a fully lowered position, and to an intermediate, partly lowered position; and b) a pneumatic control for applying compressed gas thereto, such that the cylinder can provide a full stroke to move the shaft from the full raised position to the fully lowered position to perform an ore dispensing operation and a crust breaking operation; a partial stroke between the fully raised position and the intermediate position to perform an ore dispensing operation without a crust breaking operation; and a partial stroke between said intermediate position and said fully lowered position to perform a crust breaking operation without an ore feeding operation.

2. The crust breaker and ore feeder device of claim 1, wherein said in-line three-position cylinder is formed as a tandem three-position cylinder having upper and lower cylinder portions axially aligned, and having respective upper and lower pistons, with the upper piston having a short stroke sufficient to carry out an ore dispensing operation without a crust breaking operation, and the second piston having a long stroke sufficient to carry out a crust breaking operation.

3. The crust breaker and ore feeder device of claim 2, comprising an upper cap at a top end of the cylinder, a lower cap at a lower end of the cylinder, and an intermediate stop plate positioned between the upper and lower caps; said first piston being situated between said upper cap and said intermediate stop plate and having a first rod passing through a bore in said stop plate, said second piston being disposed between the stop plate and said lower cap, and having a rod passing through a bore in said lower cap and connected to an upper end of said shaft.

4. The crust breaker and ore feeder device of claim 3, wherein the first rod has a lower end that is not connected to the second piston or the second rod, but is operative to push against the second piston when the second piston is in a raised position.

5. The crust breaker and ore feeder device of claim 1, comprising first air port disposed in said upper cap, and third and fourth air ports disposed in said stop plate and said lower cap, respectively.

6. The crust breaker and ore feeder device of claim 1, comprising first and second air ports disposed in said upper cap and said stop plate, respectively, and third and fourth air ports disposed in said stop plate and said lower cap, respectively.

7. The crust breaker and ore feeder device of claim 1, wherein said pneumatic control is situated adjacent said cylinder.

8. In a process for electrolytic smelting of aluminum from aluminum ore in which the aluminum ore is dissolved into a molten electrolyte, and in a frozen crust forms on an upper surface of the electrolyte and in which metered doses of pulverized aluminum ore are dispensed onto the top surface of the electrolyte; and in which a combination crust breaker and dispensing device is supported above the upper surface of the electrolyte and includes a vertical shaft positioned above the molten electrolyte for axial vertical motion, a crust breaker chisel mounted at a lower end thereof for breaking the crust that forms on the upper surface of the molten electrolyte, an ore dispenser situated over said shaft, in which an upper closure is open when the shaft is fully raised to admit ore into the dispenser from an ore hopper and closes when the shaft is lowered, and in which a dispensing valve releases the ore from the dispenser when said shaft is lowered; and in which a pneumatic cylinder having a rod coupled to said shaft is actuated for raising and lowering said shaft to dispense said ore and to break said crust;

the improvement wherein said pneumatic cylinder is actuated by moving the shaft between a fully raised position, a fully lowered position, and an intermediate, partly lowered position; and said cylinder:

providing a full stroke to move the shaft from the fully raised position to the fully lowered position to perform an ore dispensing operation and a crust breaking operation;

providing a partial stroke between the fully raised position and the intermediate position to perform an ore dispensing operation without a crust breaking operation; and providing a partial stroke between said intermediate position and said fully lowered position to perform a crust breaking operation without an ore feeding operation.

* * * * *